United States Patent [19]

Iijima et al.

[11] 4,034,998

[45] July 12, 1977

[54] APPARATUS FOR MOUNTING AND DISMOUNTING ATTACHMENTS

[75] Inventors: Katsuhiko Iijima; Yoshiaki Sakurai, both of Sagamihara, Japan

[73] Assignee: Mitsubishi Jukogyo Kabushiki Kaisha, Tokyo, Japan

[21] Appl. No.: 627,009

[22] Filed: Oct. 29, 1975

[30] Foreign Application Priority Data

Nov. 15, 1974 Japan ..... 49-131638

[51] Int. Cl.[2] ..... B60D 1/02

[52] U.S. Cl. ..... 280/461 R; 172/272; 214/145 A; 280/297

[58] Field of Search ..... 280/461 A, 461 R, 460 A, 280/461 R, 456 A, 456 R, 477, 497; 214/131 A, 145 A; 172/272, 273, 274

[56] References Cited

U.S. PATENT DOCUMENTS

| | | | |
|---|---|---|---|
| 3,155,250 | 11/1964 | French et al. | 280/456 R |
| 3,298,724 | 1/1967 | Coleman et al. | 280/497 X |
| 3,726,346 | 4/1973 | Thompson et al. | 172/272 |
| 3,805,980 | 3/1972 | Kisaka | 214/131 A |
| 3,887,096 | 6/1975 | Wieland | 214/145 A |

FOREIGN PATENT DOCUMENTS

| | | | |
|---|---|---|---|
| 213,563 | 6/1967 | Sweden | 214/145 A |

*Primary Examiner*—Robert R. Song
*Assistant Examiner*—John A. Pekar
*Attorney, Agent, or Firm*—Cushman, Darby & Cushman

[57] ABSTRACT

A mounting apparatus for releasably mounting attachments on a vehicle body, the apparatus comprising a bracket for securing to the vehicle body and a connecting member for securing to an attachment for the vehicle, the bracket comprising two vertically spaced projections each having an upwardly facing notch, and the connecting member having a respective pin for engaging with the notch of each projection to support the connecting member on the bracket and a locking member movable transversely of the upper projection and engageable with a contact surface formed on an underside of the upper projection to lock the respective pin in the upper projection.

3 Claims, 10 Drawing Figures

PRIOR ART
-FIG. 1.-

APPARATUS FOR MOUNTING AND DISMOUNTING ATTACHMENTS

BACKGROUND OF THE INVENTION

This invention relates to a mounting apparatus for releasably mounting attachments on construction and farming vehicles such as bulldozers and tractors.

In the field of the construction and farming vehicles such as bulldozers, tractor shovel, wheel loaders and farming tractors, it has been tried to increase the application ranges of one vehicle by utilizing various attachments. For example, in the case of an excavator of the shovel type, various attachments are provided and the excavator is made versatile by exchange of these attachments so that it can be used as a power shovel, a dragline, a backhoe, a clamshell, a crane and the like.

A prior art construction will now be described with reference to FIG. 1 of the accompanying drawings which is a side view of a backhoe mounted on a tractor by means of a known attachment.

Where an attachment is mounted on the vehicle body, as shown in FIG. 1 illustrating mounting of a backhoe B as the attachment on a tractor body A, a mounting bracket 30 is attached to one end of the body, and this mounting bracket 30 is connected to a connecting member 31 of the attachment by means of pins 32. As is shown in FIG. 1, two pins 32 are disposed to extend in the vertical direction and another two pins 32 are disposed to extend in the transverse direction of the car body, namely in the direction headed to the drawing in FIG. 1. The attachment B is fixed by these four pins 32. The load of the attachment in the vertical direction is controlled by the upper two pins. Integration of the attachment with the car body is attempted by such disposition of pins. However, since the weight of the attachment per se is very heavy, in order to simplify mounting of the attachment, according to the conventional technique, one of joint portions mounted on the upper and lower parts of the mounting bracket, namely the upper joint portion of the mounting bracket, is arranged to form a notched portion. While the pin is in the state hung on this notched portion, the pin is inserted into pin holes formed on the lower part of the bracket and the connecting member of the attachment.

According to such conventional technique, however, both the pin holes cannot easily be made so as to register well, and especially when the pin holes or the pin is deformed by the load as a result of long use, insertion of the pin is made more difficult. Moreover, these pins are inserted one by one by hand and hence, a great effort is required for insertion of pins. Therefore, it often happens that insertion of pins cannot be accomplished by one worker.

SUMMARY OF THE INVENTION

In accordance with the present invention, there is provided a mounting apparatus for releasably mounting attachments on a vehicle body, the apparatus comprising a bracket for securing to the vehicle body and a connecting member for securing to an attachment for the vehicle, the bracket comprising two vertically spaced projections each having an upwardly facing notch, and the connecting member having a respective pin for engaging with the notch of each projection to support the connecting member on the bracket and a locking member movable transversely of the upper projection and engageable with a contact surface formed on an underside of the upper projection to lock the respective pin in the upper projection.

BRIEF DESCRIPTION OF THE DRAWINGS

For a better understanding of the present invention and to show how it may be carried into effect, reference will now be made, by way of example to FIGS. 2 to 10 of the accompanying drawings which illustrate one embodiment of the invention and in which:

FIG. 8 showing the state before locking of the hitch lever, FIG. 9 showing the locking operation and FIG. 10 showing the locked state.

DETAILED DESCRIPTION

Figure 1:
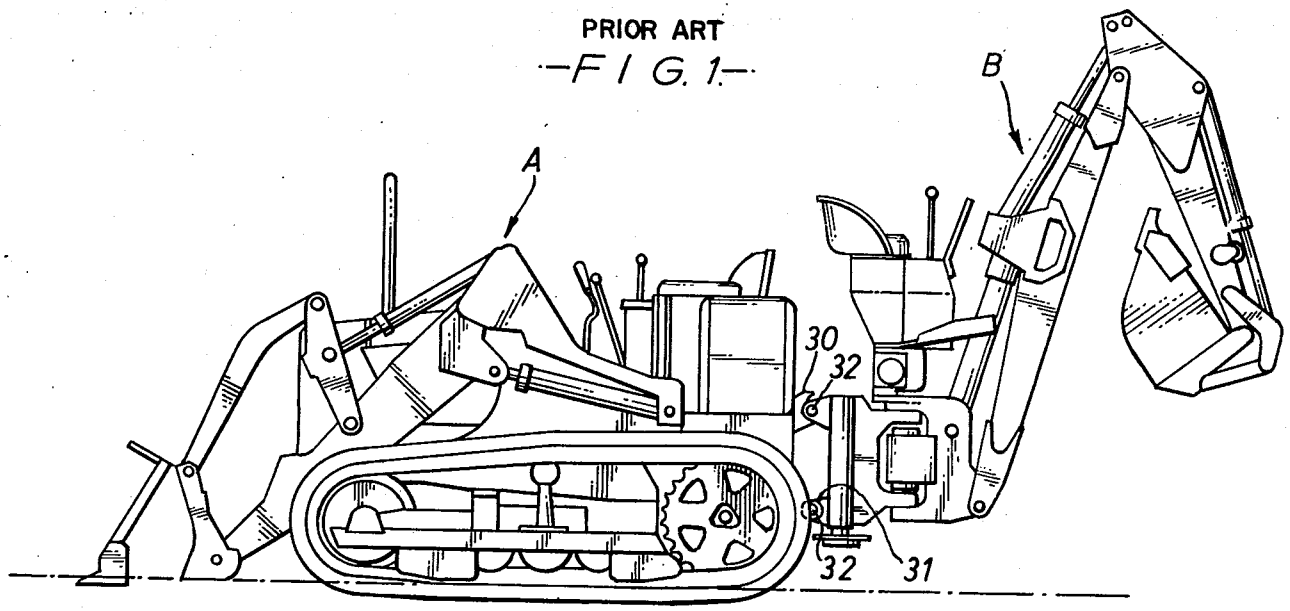

This invention will now be described in detail by reference to one embodiment where a backhoe B as the attachment is mounted on a tractor body A.

A mounting bracket 1 is attached to one end of the vehicle body A by means of a plurality of bolts 2 (FIG. 3), and above this bracket 1, there are disposed two engaging and fastening projections 5 and 6 each having an upwardly facing concave engaging notched portion 4 having an opening 3. These engaging and fastening projections are spaced from each other in the vertical direction by a predetermined distance. As is apparent from FIGS. 5 and 6, two pairs of these projections spaced by a predetermined distance in the transverse direction of the vehicle body A, namely in the direction headed toward the drawings in FIGS. 2, 3 and 4. Four projections 5, **5*a*, 6 and 6*a*** are provided.

A bracket 7 is attached to the backhoe B as the attachment to be mounted on the vehicle body A and this bracket 7 forms a connecting member. Upper and lower hanging pins 8 and 9 are attached to this bracket or connecting member 7 and they are spaced in the vertical direction by a distance corresponding to the vertical spacing between the concave engaging notched portions 4. As is seen from FIGS. 5 and 6, two pairs of upper and lower hanging pins are disposed spacedly in the transverse direction of the vehicle body A as in the case of the engaging and fastening projections 5, **5*a*, 6 and 6*a*. Four hanging pins 8, 8*a*, 9 and 9*a* are provided. The bracket 7 has two vertical grooves 10 disposed so that the engaging and fastening projections 5 and 5*a* are inserted into respective ones of the grooves 10 on mounting of the attachment. Further, as is seen from FIG. 7 the top end of the bracket 7 on the side of the car body diverges so that engaging and fastening projections 5, 5*a*, 6 and 6*a* are easily inserted into grooves 10. Stabilizing cylinders 11 are vertically disposed on the left and right sides respectively of a horizontal base of the bracket 7** to support the backhoe B.

Among the two pairs of upper and lower engaging and fastening projections 5, 5*a* 6 and 6*a*, the upper engaging projections 5 and 5*a* have a flat contact face 12 formed on the lower face thereof. A locking member 13 is attached to the connecting member 7 so that it can advance below this contact face 12 and retreat therefrom while having a sliding contact with the contact face 12. A guide member 14 is mounted on the connecting member 7 to control the direction of the advancing or retreating movement of the locking member 13. As is seen from FIG. 4, the locking member 13 has a form of a pin having a generally circular section, the upper portion of which is taken off to form a flat face to have a sliding contact with the contact face 12. In the embodiment shown in the drawings, the locking member 13 has such an enlarged flat face to have a sliding contact with the contact face 12, but even if no notched portion is formed and the locking member 13 has a completely round section, a desired engaging and fastening action can be attained. Moreover, the member 13 may have a rectangular section.

One end of a link 15 is rotatably mounted on the terminal end of the locking member 13 by means of a pin 16 to cause the advancing or retreating movement of the member 13, and the other end of the link 15 is attached at a position spaced from the center of the hitch lever 17 by a predetermined same distance by means of a pin 18. Accordingly, when the hitch lever 17 is rotated from the state shown in FIG. 5 to the state shown in FIG. 6, the locking member 13 is moved forwardly to the point shown in FIG. 6. In order to impart always a forwarding elastic force to the locking member 13, a twisted coil spring 20 is disposed around a pin 19 supporting rotatably the hitch lever 17, as shown in FIGS. 5, 6 and 8 to 10.

Figure 5:
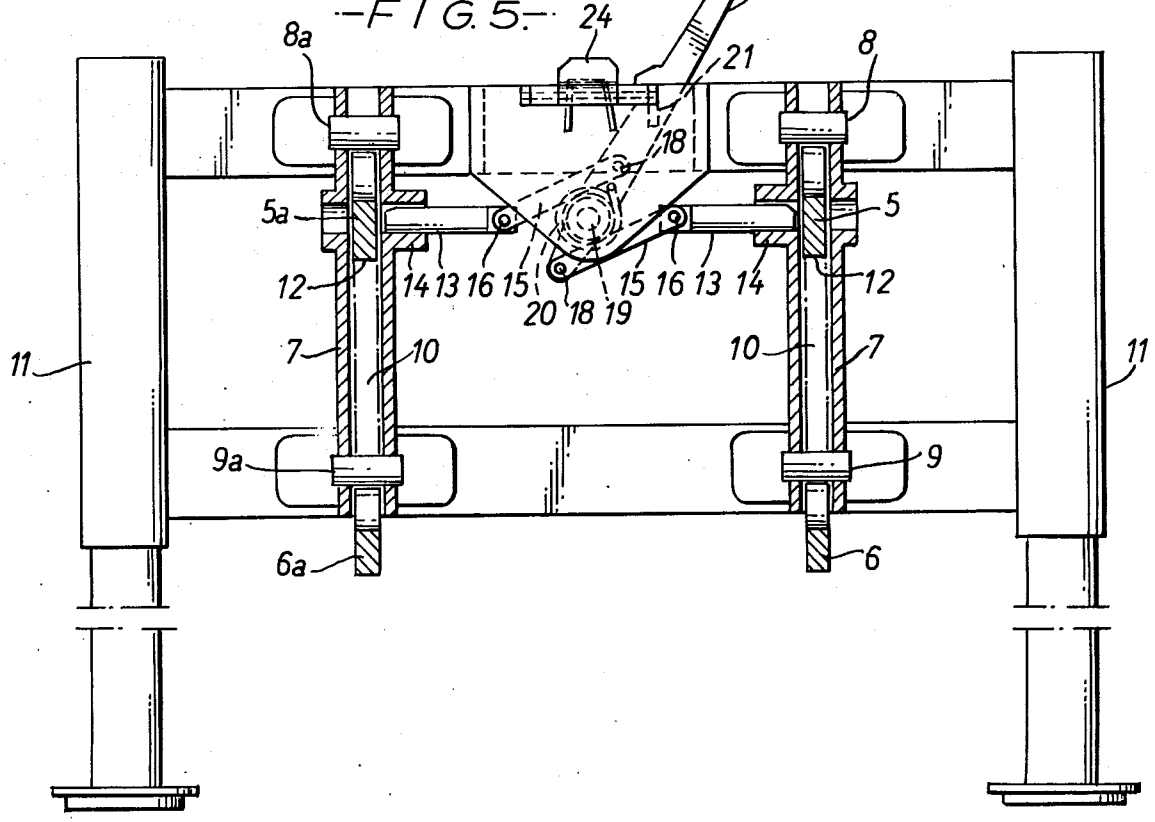
FIG. 5 is a transverse section of the apparatus as shown in FIG. 3.
Figure 6:
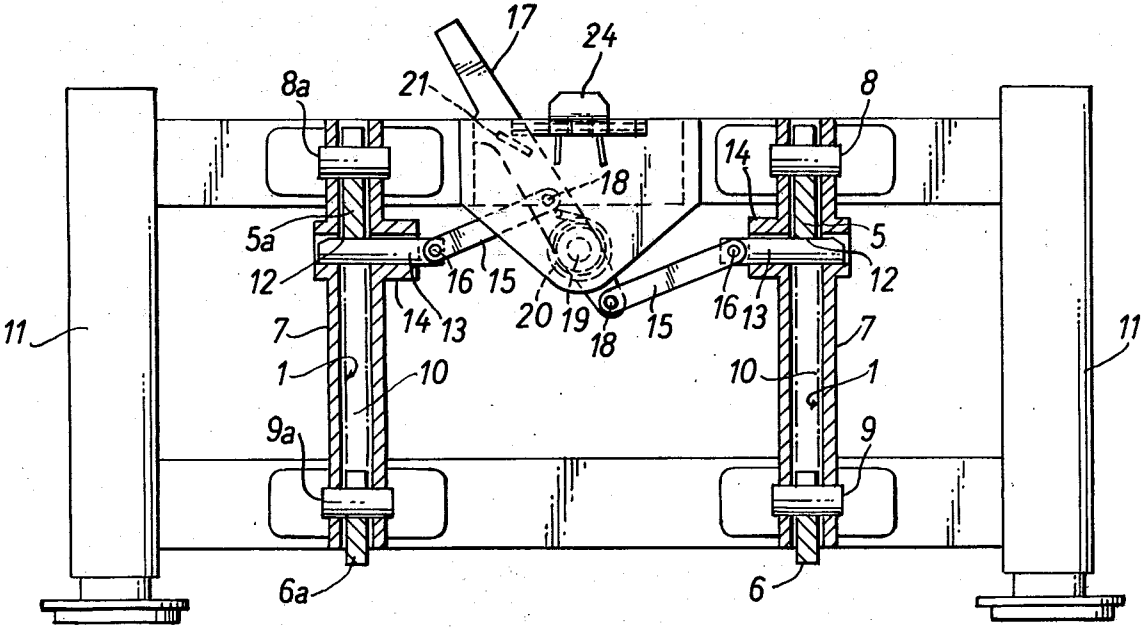
FIG. 6 is a transverse section of the apparatus as shown in FIG. 4.
Figure 8:
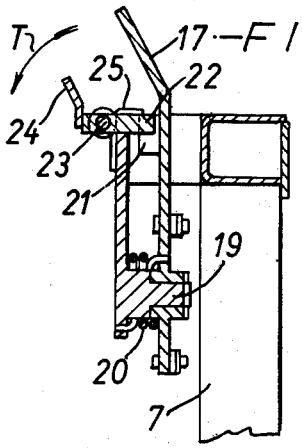
FIGS. 8 to 10 are views illustrating the operation of a mechanism for locking a hitch lever for operating a locking member.
Figure 9:
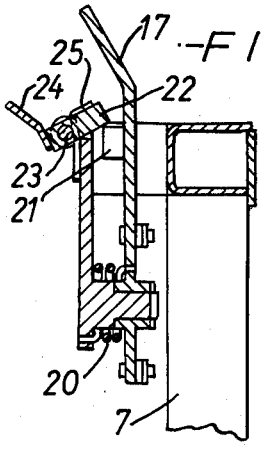
Figure 10:
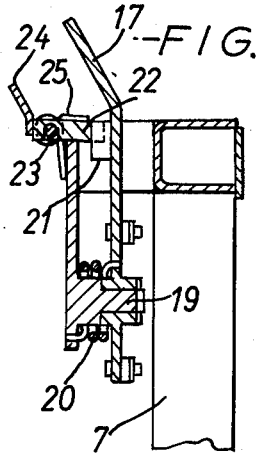

In order to maintain the retreated state in the locking member 13 when it is moved backwardly against the elastic force of the twisted coil spring 20, a fastening piece 21 is welded to the hitch lever 17, as shown in FIGS. 8 to 10. A stopper plate 22 to be engaged with this fastening piece 21 is disposed so that it can rotate with a pin 23 as the center. When a lever 24 fixed to the stopper plate 22 is actuated to incline the stopper plate 22 from the horizontal level, the hitch lever 17 is allowed to rotate toward the position shown in FIG. 6. A return spring 25 is attached around the pin 23 to maintain always the stopper plate 22 in the horizontal position. Accordingly, when the hitch lever 17 is rotated from the state shown in FIG. 5 to the state shown in FIG. 6, the fastening piece 21 is engaged with the stopper plate 22 to control the return of the hitch lever 17 from the state shown in FIG. 6 to the state shown in FIG. 5 by means of the twisted coil spring 20. In order to move the rotation of the hitch lever 17 from the state shown in FIG. 6 to the state shown in FIG. 5 even without rotating the lever 24, the lower face of the stopper plate 22 on the right side in FIGS. 5 and 6 is formed into an inclined face, so that during rotation of the hitch lever 17 the fastening piece 21 moves while having a sliding contact with the lower face of the stopper plate 22.

Figure 2:
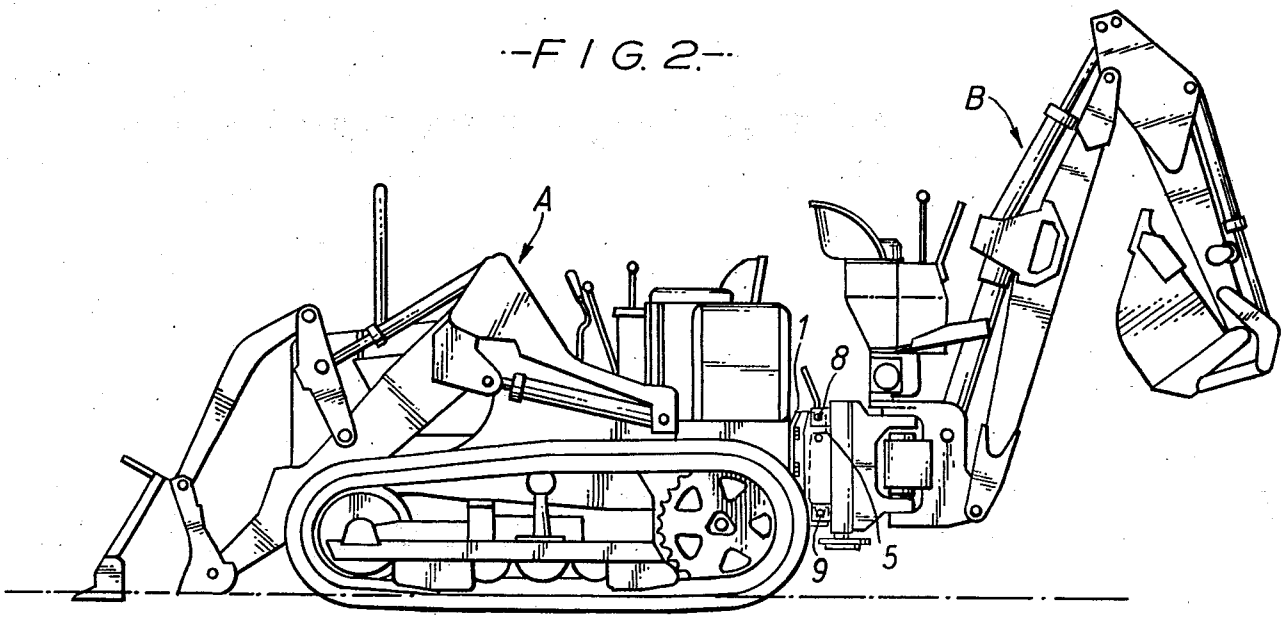
Fig. 2 is a side view illustrating a backhoe mounted on a tractor.
Figure 3:
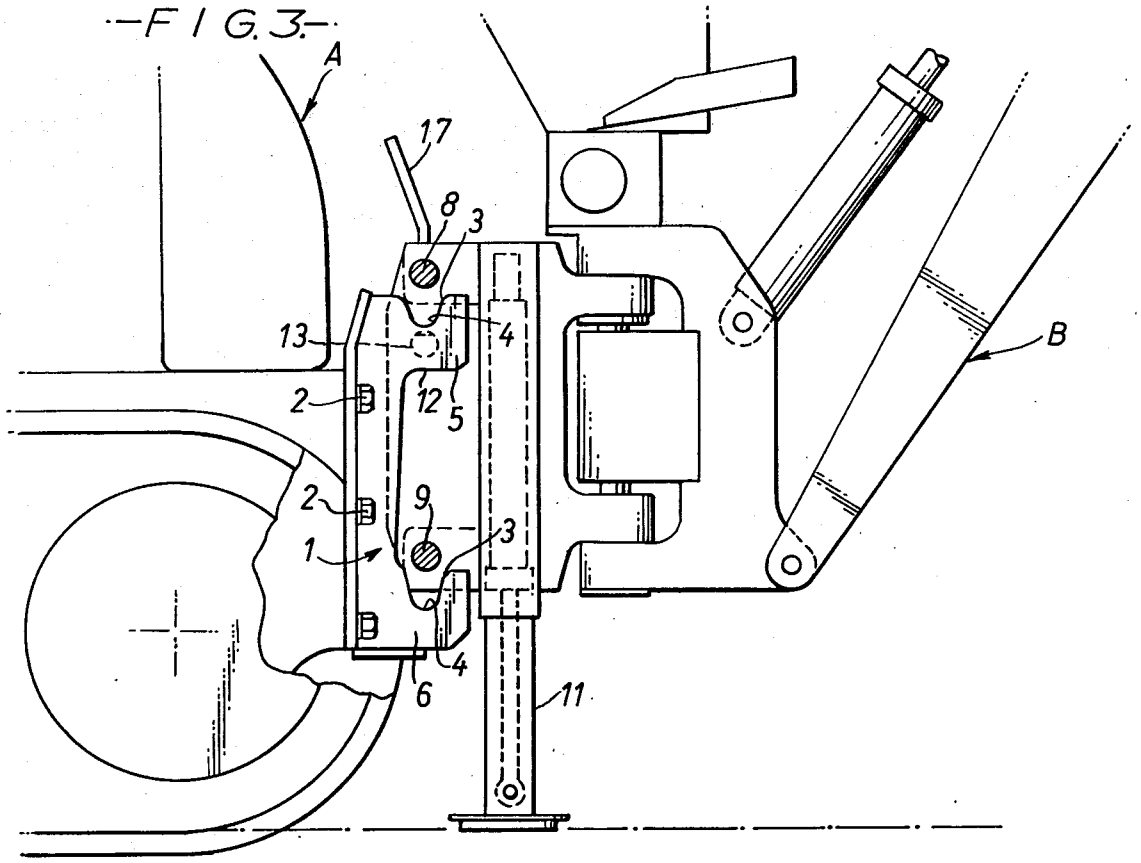
FIGS. 3 and 4 are views illustrating the operation of an attachment-mounting apparatus according to this invention, FIG. 3 showing the state before mounting and FIG. 4 showing the state after mounting.
Figure 4:
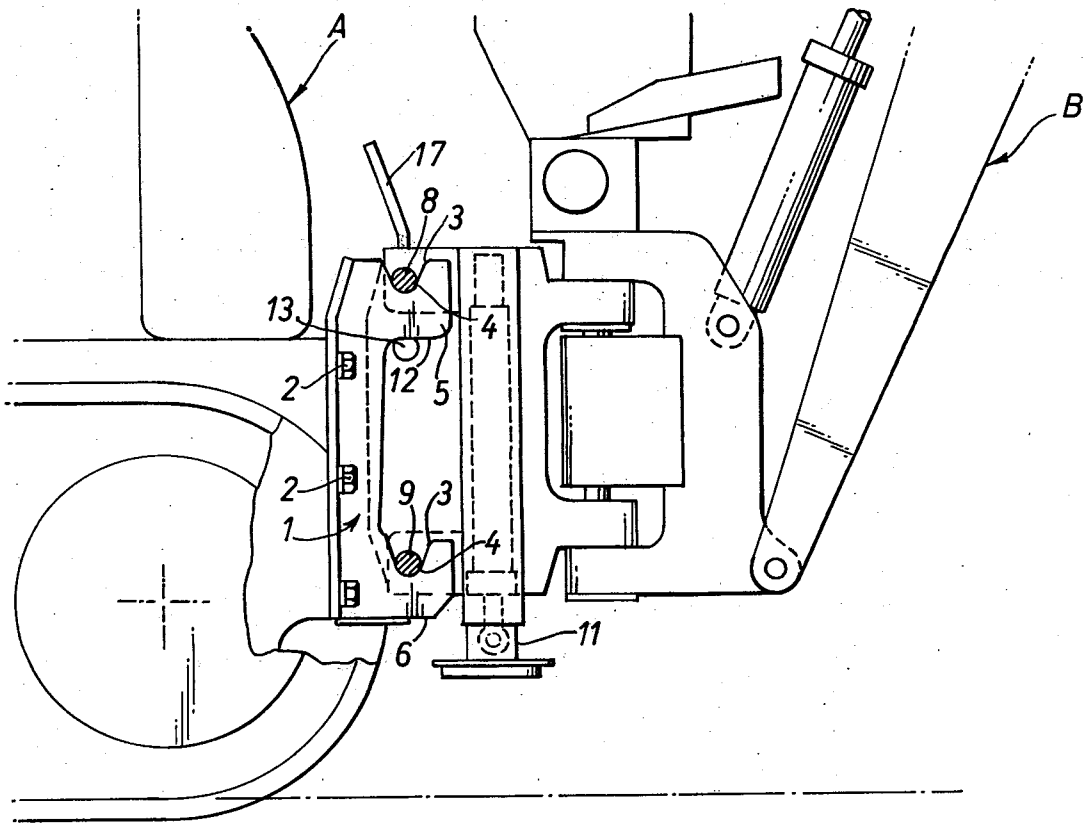

In the above embodiment, as is apparent from FIGS. 2 to 4, two engaging and fastening projections 5 and 6 are mounted on the bracket 1 so that they are spaced from each other in the vertical direction by a predetermined distance, and hanging pins 8 and 9 are engaged with concave engaging notched portions 4 of these engaging and fastening projections 5 and 6. This arrangement is made so that the vertical load of the backhoe B as the attachment is supported at two points, and the vertical load can be sufficiently supported by this arrangement. It is possible to dispose additional engaging projections and hanging pins between said engaging and fastening projections and between the two hanging pins, respectively. Further, as is seen from FIGS. 5 and 6, two pairs of the engaging and fastening projections are disposed so that they are spaced from each other in the transverse direction of the vehicle body A. By this arrangement, the load imposed on the backhoe B in the right-and-left direction especially when the machine body A is turned can be supported at right and left two points. Accordingly, additional engaging and fastening projections may be disposed at intermediate points in the right-and-left direction. Furthermore, the load imposed on the backhoe B in the left-and-right direction can be supported by the face-to-face contact between the bracket 1 of the vehicle body A, and the connecting member 7. In this case, it is possible to dispose only one pair of upper and lower engaging and fastening projections 5 and 6 corresponding hanging pins 8. This embodiment is adopted conveniently when the weight of the attachment is relatively light.

In the above embodiment shown in the drawings, the contact face 12 is formed on the upper engaging and fastening projection. The projection on which the contact face 12 is to be formed is determined in view of the easiness of the lever operation and the positional relationship of the vehicle body A to other equipments, and in the attachment-mounting apparatus of this invention, the contact face 12 may be formed on the lower engaging and fastening projection. In short, in this invention, it is only indispensable that such arrangement should be made that the locking member 13 can advance toward below the engaging and fastening projection 5 and retreat therefrom. As is seen from FIGS. 5 and 6, the top end portion of this locking member 13 is chamfered so as to facilitate the foreward movement of this member 13. It is possible to use a member 13, the whole of which is gradually tapered toward the foreward end thereof. When such member 13 is used, even if the upper face of the locking member 13 having a sliding contact with the contact face 12 is worn by long use, the member 13 can further advance by a distance corresponding to such wearing and therefore, the sliding contact can be conveniently maintained between the upper face of the member 13 and the contact face 12 regardless of such wearing.

Mounting of a backhoe as the attachment on a vehicle body by utilizing the attachment-mounting apparatus of the present embodiment will now be described.

Figure 7:
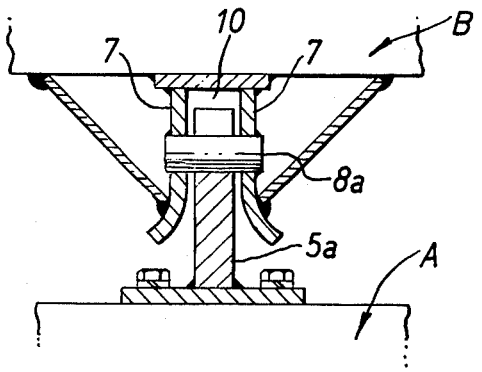
FIG. 7 is a view illustrating the state where a hanging pin is engaged and fastened with a notched portion.

In the first place, the stabilizer cylinder 11 is stretched by the operation of a control lever to elevate the backhoe B, and after the positions of the hanging pins 8 and 8*a* have become sufficiently raised so as to be higher than the position of the opening 3 of the bracket 1, the backhoe B is brought toward the side of the vehicle body above the opening 3. Then, the stabilizer cylinder 11 is actuated again to lower the backhoe B and all the hanging pins 8, 8*a*, 9 and 9*a* are engaged with concave engaging and fastening notched portion 4 thereby to effect the connecting operation. When the backhoe B is brought toward the vehicle body by moving the vehicle body towards the side of the bracket B, since the front face of the bracket 7 may diverge as shown in FIG. 7, the connection operation can easily be accomplished.

Then, the lever 24 of the stopper plate 22 is inclined in the direction indicated by arrow T in FIG. 8 against the spring force, the engagement between the stopper plate 22 and the engaging piece 21 is released, and the hitch lever 17 is rotated from the state shown in FIG. 6 to the state shown in FIG. 5 by the force of the twisted coil spring 20, whereby the force of the twisted coil spring 20 is transferred to two locking members 13 through the link 16 to advance the members 13. The upper face of each locking member 13 is contacted with the contact face formed on the lower face of the engaging and fastening projection 5 to thereby fix the connected state. At this stage, the engaging and fastening projection 5 of the bracket 1 is gripped by the hanging pins 8 and 8*a* and the locking member 13, whereby the vertical movement of the projection 5 is controlled.

Where the above connected state is to be unlocked and the attachment B is to be dismounted from the vehicle body A, the hitch lever 17 is first rotated from the state shown in FIG. 6 to the state shown in FIG. 5 to retreat the locking member 13 and withdraw the member 13 from the contact face 12 formed on the lower face of the engaging and fastening projection 5. At this moment, as the hitch lever 17 is being brought down, the engaging piece 21 welded to the hitch lever 17 moves while having a rubbing contact with the lower face of the stopper plate 22. Accordingly, as shown in FIG. 9, the stopper plate 22 is gradually raised, and the moment when the engaging piece 21 leaves the stopper plate 22, by the action of the return spring 25 the stopper plate 22 is returned to the state shown in FIG. 10 and the hitch lever 17 is locked.

It will be appreciated that the bracket 1 can be formed integrally with a vehicle and that the connecting member 7 can form an integral part of the attachment.

According to this invention, at least two engaging and fastening projections disposed at upper and lower portions of the bracket to be attached to the car body, and concave engaging notched portions are formed on these engaging and fastening projections and hanging pins engaged with these notched portions are attached to the connecting end portion of the attachment. Further, a clamping face is formed on the lower face of one of these two engaging and fastening projections, and the locking member is disposed so that it can advance below this clamping face and retreat therefrom while having a sliding contact with said clamping face. This locking member is so arranged that it can move below the clamping contact face while keeping the hanging pins in the state engaged with the notched portions and the engaging and fastening projections of the bracket are gripped and fastened by the hanging pins and the locking member. By adopting the above arrangement, the load of the attachment is supported at two points where the two hanging pins are present, respectively, and while the attachment is supported on the bracket by means of the hanging pins, no weight of the attachment is imposed on the locking member which performs the action of fixing the attachment. Therefore, mounting and dismounting of the attachment can be accomplished very simply only by the advancing and retreating movement forces of the locking member.

Although the present invention has been described with reference to the embodiment as shown in the attached drawings, various modifications can be applied to the present invention within the range not departing from the gist of the present invention. For example, the following embodiment is included in the present invention.

A mounting apparatus for releasably mounting attachments on a vehicle body, the apparatus comprises a bracket comprising two vertically spaced engaging and fastening projections each having an upwardly facing concave engaging notch provided at a predetermined interval, a pin for engaging with the notch of the bracket on the side of the attachments provided at a connecting member on the side of the vehicle, a contact surface provided on the underside of either one of said two engaging and fastening projections, a locking member movable transversely in a sliding contact with said contact surface toward the underside of said contact surface provided at said connecting member, and transferring said locking member to the underside of said contact surface while said pin engages with said notch to lock said connecting member by said engaging pin and said locking member.

What we claim is:

1. A mounting apparatus for releasably mounting an attachment on a vehicle body, comprising:

a bracket for securement to the vehicle body;

a connecting member for securement to the attachment;

the bracket including two vertically spaced projections, each having means defining an upwardly opening notch;

the connecting member including two respective pins, vertically spaced and extending transversally, for being cradled in the respective notches to connect the connecting member to the bracket; and a locking member, releasably actuable to prevent the connecting member from being raised sufficiently to permit the respective upper one of said pins from clearing the respective upper one of said notches;

the locking member including means providing a contact surface on the underside of the respective upper one of said projections; a transversally extending lock pin mounted for movement transversally between a first operative position wherein said lock pin underlies and engages said contact surface, and a second inoperative portion wherein said lock pin clears said contact surface sufficiently to permit the connecting member to be raised enough to disconnect the connecting member from the bracket; and a hitch lever member secured crank fashion to the lock pin for actuating the lock pin between said first and second positions thereof.

2. The mounting apparatus of claim 1, wherein:

the hitch lever member is pivotally secured on the connecting member and is further provided with a resilient spring biased between the hitch member and the connecting member in a sense to tend to urge the lock pin to said first, operative position; and further including a stop plate movably mounted on the connecting member for selectively obstructing return of the hitch lever member, in order to maintain the lock pin in the second, inoperative position when desired.

3. The mounting apparatus of claim 1, wherein:

the bracket further including a second set of vertically spaced projections, transversally spaced from the first-mentioned two projections, each of the projections of the second set having means defining an upwardly opening notch;

the connecting member further including a second set of two respective pins, transversally spaced from the first-mentioned two pins, for being cradled in the notches of said second set;

the locking member further including means providing a second contact surface on the underside of the respective upper one of the second set of projections; a second transversally extending lock pin mounted for movement transversally between a first, operative position wherein said second lock pin underlies and engages said second contact surface, and a second, inoperative position wherein said lock pin clears said second contact surface sufficiently to permit the connecting member to be disconnected from the bracket;

said hitch lever member being secured crank fashion to said second lock pin for simultaneously actuating both said lock pins between said first and second positions thereof.

* * * * *